US006733825B1

(12) United States Patent
Wendler

(10) Patent No.: US 6,733,825 B1
(45) Date of Patent: May 11, 2004

(54) METHOD FOR DECORATING THE INTERIOR SURFACE OF FRUITS AND VEGETABLES

(75) Inventor: Eric Beard Wendler, Mt. Airy, MD (US)

(73) Assignee: Eric B. Wendler, Mt. Airy, MD (US)

( * ) Notice: Subject to any disclaimer, the term of this patent is extended or adjusted under 35 U.S.C. 154(b) by 0 days.

(21) Appl. No.: 10/385,270

(22) Filed: Mar. 10, 2003

(51) Int. Cl.[7] ..... B05D 7/22
(52) U.S. Cl. ..... 427/181; 427/230
(58) Field of Search ..... 427/181, 183, 427/230, 231, 242; 428/7, 15, 17, 22; 426/250, 289, 293, 295, 302, 308, 383

(56) References Cited

U.S. PATENT DOCUMENTS 4,828,114 A * 5/1989 Bardeen ..... 206/575
5,162,138 A * 11/1992 Caflisch et al. ..... 428/17
5,897,797 A * 4/1999 Drouillard et al. ..... 219/121.68
6,055,738 A * 5/2000 Bardeen et al. ..... 33/566
6,093,446 A * 7/2000 Bardeen ..... 427/146
6,267,036 B1 * 7/2001 Lani ..... 83/660

OTHER PUBLICATIONS

MSDS for Palmer "Dry Tempera" 9940, manufactured by Palmer Paint Products, Inc., 1291 Rochester Rd., Troy, MI, 48083, tel. 1–248–588–4500, prepared May 2002, 2 pages.

* cited by examiner

*Primary Examiner*—Shrive P. Beck
*Assistant Examiner*—William Phillip Fletcher, III

(57) ABSTRACT

The present invention provides a product, a method and a kit for decorating the interior surface of fruits and vegetables that have an area for displaying a design. In a preferred embodiment, the product comprises a nontoxic paint powder and a sheet of materials with two components: component 1 is a sheet of material capable of acting as a release liner for component 2; component 2 is a sheet of material capable of adhering to the surface of fruits and vegetables. The method comprises steps in which: component 1 is removed from component 2; component 2 is contacted and adhered over the decorative carved image on the fruit or vegetable; the nontoxic paint powder is placed inside the fruit or vegetable; a user manipulates the fruit or vegetable so the nontoxic paint powder disperses and covers the interior of the fruit or vegetable; and component 2 is then removed from contact with the fruit or vegetable thereby revealing the pattern on the fruit or vegetable and the decorative color from the nontoxic paint powder.

7 Claims, 5 Drawing Sheets

METHOD FOR DECORATING THE INTERIOR SURFACE OF FRUITS AND VEGETABLES

FIELD OF THE INVENTION

The present invention is directed to a product, a method and a kit for decorating a surface. Particularly, the present invention is directed to a product, method and kit for decorating the interior surface of fruits and vegetables.

BACKGROUND OF THE INVENTION

The present invention is directed to the decoration of fruits and vegetables in a new, useful and easy manner. Specifically, the present invention concerns decorating items of produce, such as pumpkins, in order to provide a decorative coloring. Of particular concern is providing a product, a method and a kit for decorating the interior of pumpkins for Halloween.

Pumpkin carving has long been one of the traditional ways in which Halloween is celebrated. Generally, pumpkin carving involves the removal of a portion of the pumpkin shell surrounding the stem, removal of the seeds and fibers contained in the pumpkin and thereafter carving humorous, grotesque or other decorative features partially or wholly through the pumpkin shell by removing fleshy portions of the shell to obtain the desired appearance. Internal illumination is then provided either by a candle or a battery operated light to result in a glowing decorative pattern.

The intricate carving of pumpkins on a wide scale basis came about in the mid-1980's as a result of the introduction of pumpkin carving kits. The elements of these kits are set forth in U.S. Pat. No. 4,828,114 entitled Pumpkin Carving Kit issued May 9, 1989 to Bardeen and U.S. Pat. No. 6,093,446 entitled Method for decorating surfaces with transfer patterns issued Jul. 25, 2000 to Bardeen.

In the kit described in the '114 Patent, elaborate patterns are provided that are transferred onto the surface of a pumpkin by poking small holes through patterns. The patterns are printed onto paper sheets. In order to transfer the pattern to the pumpkin, users must position the paper sheet onto the pumpkin by pushing thumbtacks through the paper then into the shell of the pumpkin. Users then take a sharp plastic tool and push the tool through the pattern on the paper into the shell of the pumpkin. This process results in a series of holes in the shell of the pumpkin that is in the shape of the pattern on the paper. Users then remove the paper sheet and carve the pattern by comparing the holes on the shell with the pattern on the paper sheet.

The pumpkin carving kits and techniques of these references provide alternative solutions to carve the exterior of pumpkins. However, there is a need for a method that provides decorative colors onto the interior of a pumpkin. These colors would help complement, accent and highlight decorative patterns that are carved in pumpkins.

SUMMARY OF THE INVENTION

It is an object of the present invention to provide a new, useful product, method and kit adapted to decorate interior surfaces in general, but specifically the interior surface of a fruit or vegetable, such as a pumpkin.

The present invention provides a product, a method and a kit for decorating the interior surface of fruits and vegetables that have an area for displaying a design. In a preferred embodiment, the product comprises a nontoxic paint powder and a sheet of materials. The sheet of materials acts as a barrier to keep the nontoxic paint powder inside the fruit or vegetable. The sheet of materials has two components: component 1 is a sheet of material capable of acting as a release liner for component 2; component 2 is a sheet of material capable of adhering to the surface of fruits and vegetables. The method comprises steps in which: component 1 is removed from component 2; component 2 is contacted and adhered over the decorative carved image on the fruit or vegetable; the nontoxic paint powder is placed inside the fruit or vegetable; a user manipulates the fruit or vegetable so the nontoxic paint powder disperses and covers the interior of the fruit or vegetable; and component 2 is then removed from contact with the fruit or vegetable thereby revealing the pattern on the fruit or vegetable and the decorative color from the nontoxic paint powder.

These and other objects of the present invention will become more readily appreciated and understood from a consideration of the following detailed description of the exemplary embodiments when taken together with the accompanying drawings:

Figure 1:
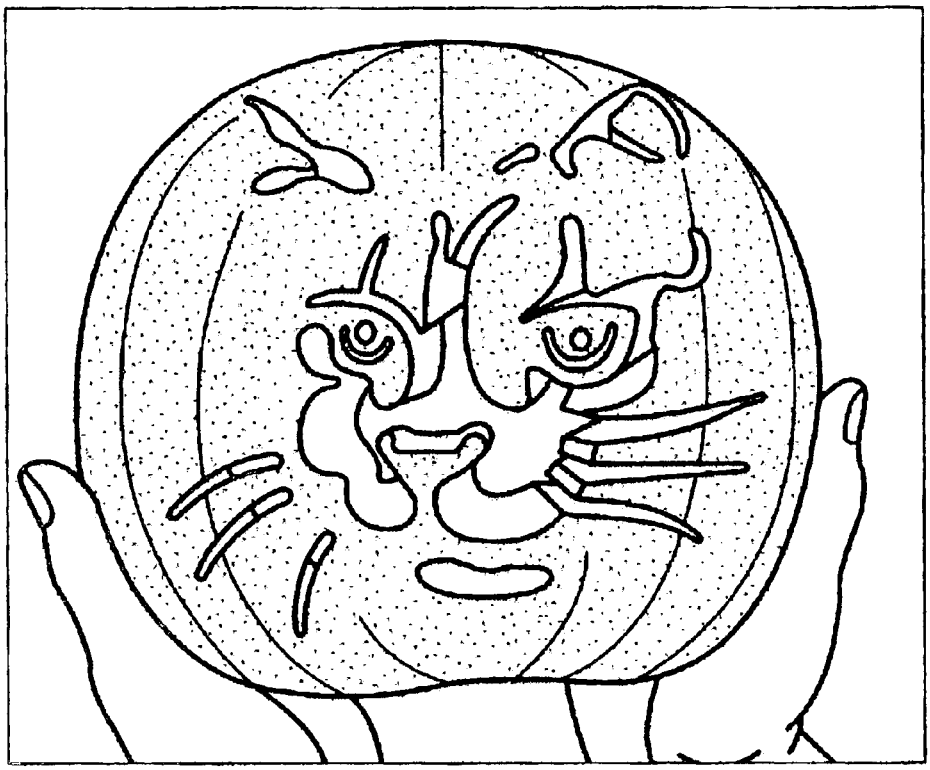
FIG. 1 shows a carved pumpkin.
Figure 2:
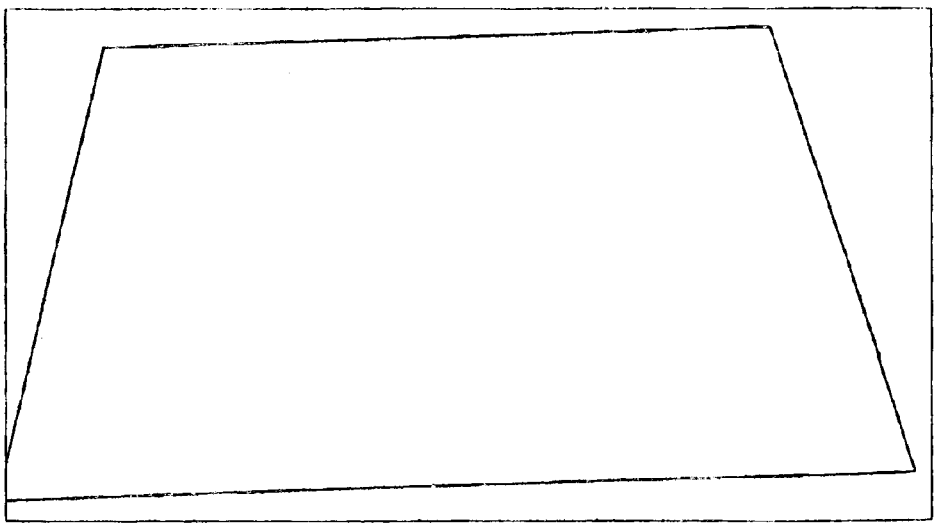
FIG. 2 is a perspective view of the sheet of material according to the preferred embodiment of the present invention.
Figure 3:
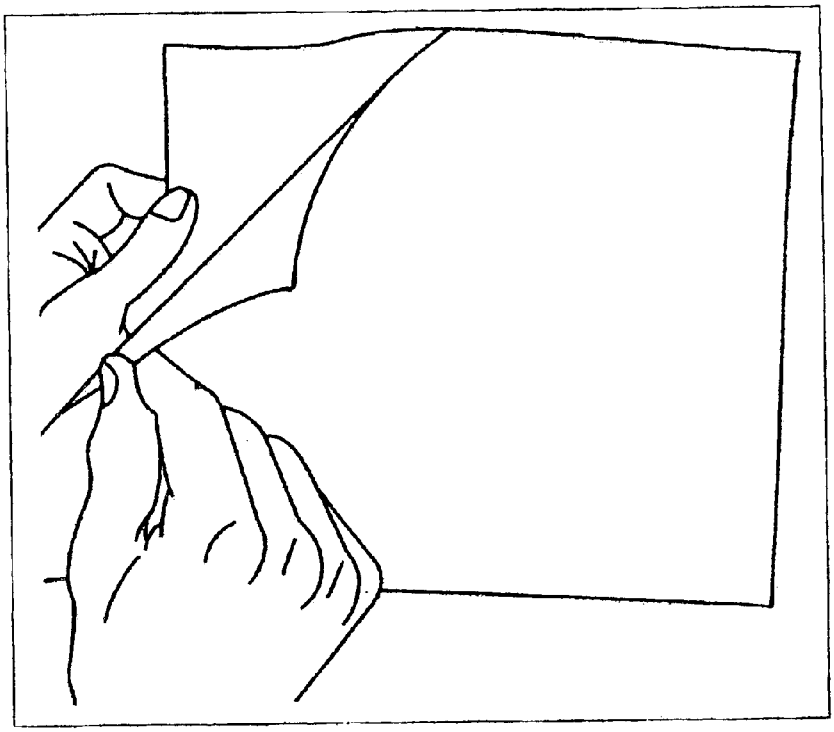
FIG. 3 is a perspective view of the sheet of FIG. 2 partially pulled away from the liner sheet to expose the adhesive layer under the sheet.

The invention comprises a product, a kit containing the product and a method of using the product.

The properties and attributes of the nontoxic paint powder can be found at the end of this document in Addendum 1—Material Safety Data Sheet of Palmer Dry Tempera Paint.

The sheet of materials in the product of the invention includes at least two components: Component 1 is a sheet of material capable of acting as a release liner for component 2. Component 2 is a sheet of material capable of acting as the surface for a pattern and capable of adhering to the surface of a fruit or vegetable. In combination, at least one surface of component 2 is adhesive and is in contact with said component 1. Component 2 thus has at least one surface which will adhere to fruit and the other surface which is blank. In a very specific embodiment this product may be sold as a kit, with or without additional items; additional items may include a scoop, carving utensils and knives for carving which may be varied in size.

In a preferred embodiment, properties of component I would be a 50# semi-bleached densified kraft liner with specifications as shown below:

| | TARGET | RANGE | TEST |
|---|---|---|---|
| Basis Weight: | 53 lbs. ** 86.3/m2 | | TAPPI T-410 |
| Ream Basis: | 24" × 36" -500 sheets | | |
| Caliper: | 3.2 mils 81.3 | 2.9–3.4 mils 73.7–86.4 | TAPPI T-411 |
| Tensile: | MD: 45 lbs./in. (7.88 kN/m) CD: 21 lbs./in. 3.68 kN/m | MD: 32 lbs./in. minimum (5.60 kN/m) CD: 15 lbs./in. minimum 2.Ei3 kN/m | TAPPI T-494 |
| Tear: | MD: 50 grams (490 mN) CD: 58 grams 569 mN | MD: 35 grams minimum (343 mN) CD: 40 grams minimum 392 mN | TAPPI T-414 |
| Opacity: | 70% | 80% maximum | TAPPI T-425 |

Other types of material (such as synthetic material, layers of polyethylene LLDPE, and high density polyethylene) could substitute for the material described above to create component 1.

The sheet (component 2) would be a 50# EDP smudge resistant medium with specifications as Shown below:

| | TARGET | RANGE | TEST |
|---|---|---|---|
| Basis Weight: | 50 lbs. 74.0/m2 | 48.0–52.0 lbs 71.0–77.0/m2 | TAPPI T-410 |
| Ream Basis: | 25" × 38" -500 sheets | | |
| Caliper: | 3.6 mils 91.0 | 3.4–3.8 mils 86.3–96.5 | TAPPI T-411 |
| Tensile: | MD: 37 lbs./in. (6.48 kN/m) TD: 22 lbs./in. 3.85 kN/m | MD: 26 lbs./in. minimum (4.55 kN/m) TD: 16 lbs./in. minimum 2.80 kN/m | TAPPI T-494 |
| Tear: | MD: 51 grams (500 mN) CD: 51 grams 500 mN | MD: 45 grams minimum (441 mN) CD: 40 grams minimum 441 mN | TAPPI T-414 |
| Smoothness: (Felt) Sheffield units | 73 | 160 Maximum | TAPPI T-538 |
| Opacity: | 84.5% | 80% Minimum | TAPPI T-425 |
| Brightness: | 87% | 85%–89% | TAPPI T-452 |

Other types of material (such as synthetic material) could substitute for the material described above to create component 2. Component 2 is a sheet of material capable of adhering to the surface of a fruit or vegetable.

Thus one surface of component 2 will bear an adhesive or exhibit a blocking quality whereas the other surface of the sheet material will be blank. The general purpose permanent adhesive used to adhere the medium onto the surface of a fruit or vegetable enables the medium to be removed from the surface of a fruit or vegetable. The general purpose permanent adhesive is preferably nontoxic to humans. One type of adhesive, designated self-adhesive or self-stick adhesive and used on white labels, is an acrylic emulsion-based permanent adhesive. This type of adhesive is suitable for general purpose adhesion to most paper, bare and painted metal, polypropylene and polyethylene, and generally should not be used on leather, suede, corduroy, velvet, silk, vinyl and plastic. Moisture sensitive adhesives may also be employed; these are sometimes referred to as remoist adhesives. When moisture sensitive adhesives are employed, the liner is not an essential element of the invention; this embodiment is not preferred. When a moisture sensitive adhesive is employed, use of the composite of the invention requires the step of moistening the adhesive. In fact, the exact nature and identity of the adhesive is not per se critical. The clear label products use a solvent based permanent adhesive which is also suitable for general purpose applications.

In the preferred embodiment, the type of adhesive used to affix the pattern sheet onto the surface of a fruit or vegetable would be a tackified general purpose permanent adhesive with excellent adhesion to many substrates with specifications as shown below:

ADHESIVE 758: P758 is a tackified general purpose permanent with great die-cutting and stripping properties. Excellent adhesion to many substrates, especially corrugated.

QUICK TACK: 35 oz/in 2 minimum (0.98 Kg/25 mm)

MINIMUM APPLICATION TEMPERATURE: 40° F. (4° C.)

RECOMMENDED SERVICE TEMPERATURE RANGE.: −65° F. to 200° F. (−54° C. to 93° C.)

SHELF LIFE: One year

| 90 DEGREE PEEL | |
|---|---|
| SUBSTRATE | DWELL TIME Lb./in. (Kg/m) Immediate |
| STAINLESS STEEL | 1.4 (25.00) [Paper Tear] |
| POLYETHYLENE | 1.0 (17.86) |
| CORRUGATED | 0.8 (14.29) [Fiber Tear] |

Other types of adhesives could also be used, such as less aggressive, removable grades of adhesive.

This invention was developed by obtaining label material from Green Bay Packaging, Inc. 50# EDP, Green Bay, Wsin. The sample label material was cut down to 8½"×11" size.

While the present product and method are described with respect to the decorating of fruits (pumpkins, melons, etc.) it is to be understood that, in its broadest form, the present invention could be employed to decorate other surfaces, such as vegetables (squash, gourds, etc.). The scope of this patent is not to be limited by the fact that it is described with respect to the decorating of pumpkins.

The method of the invention comprises providing fruits and vegetables and providing the product comprising a nontoxic paint powder and a sheet of materials consisting of component 1 and component 2. Prior to subsequent steps, the pumpkin, or any other vegetable or fruit may be pretreated, e.g. by carving, to remove stem, and seeds, fiber and pulp from the interior of the pumpkin, fruit or vegetable to provide a hollow spherical shell of flesh; however, that is not an essential step in the method of the invention.

Figure 4:
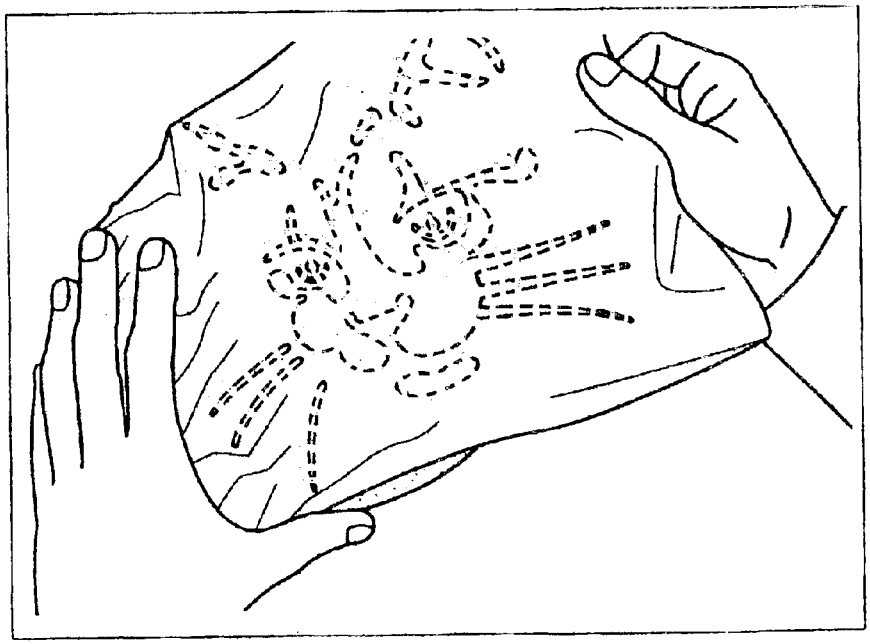
FIG. 4 shows the sheet being placed onto the pumpkin, overlaying the decorative pattern that is carved in the pumpkin.
Figure 5:
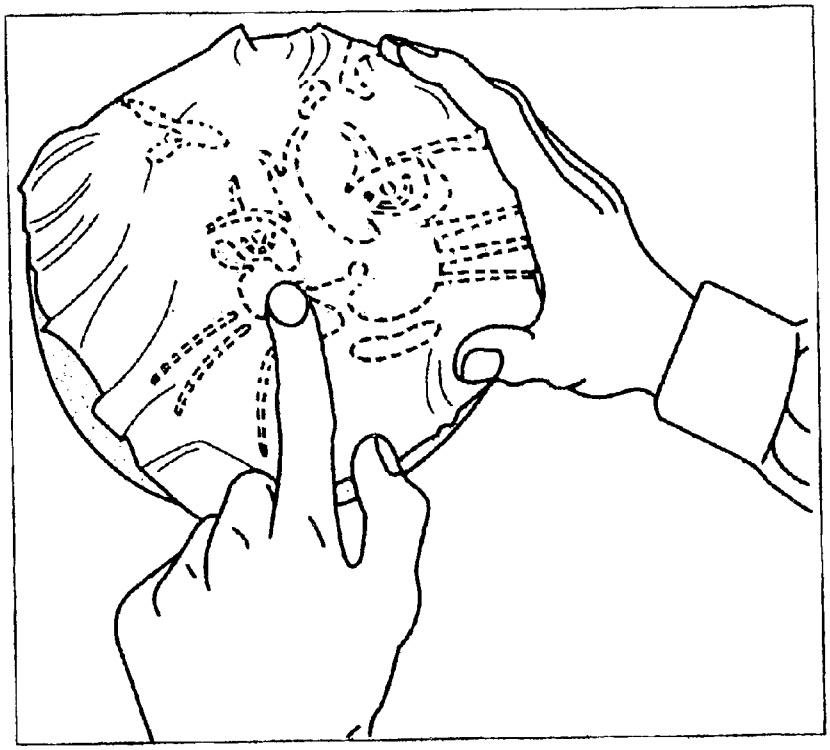
FIG. 5 shows the sheet being adhered to the surface after having been placed onto the pumpkin.
Figure 6:
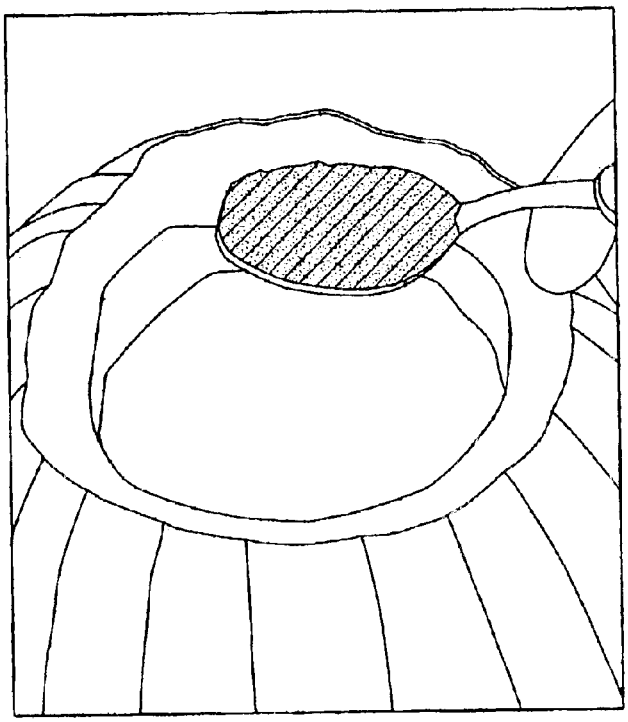
FIG. 6 shows the nontoxic paint powder being placed inside the carved pumpkin.
Figure 7:
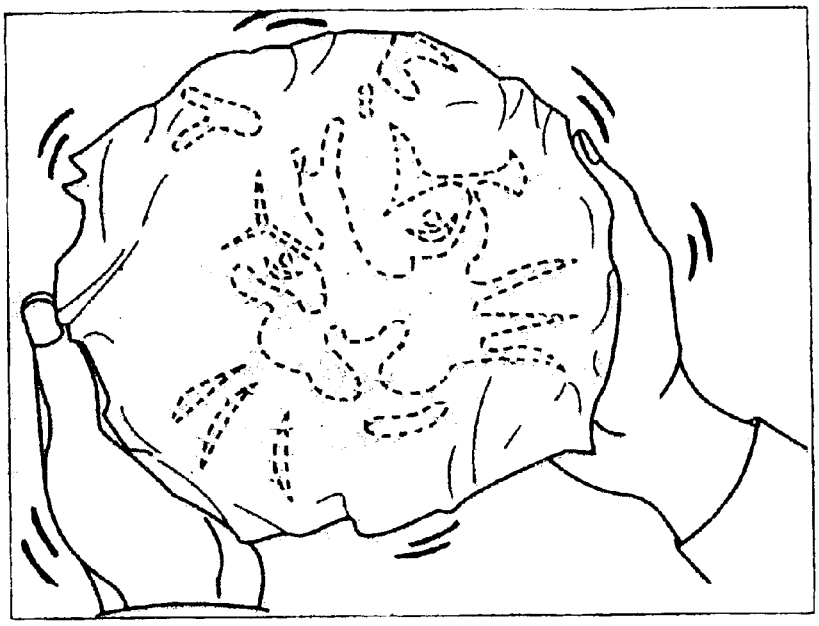
FIG. 7 shows the pumpkin being manipulated so the nontoxic paint powder disperses and covers the interior of the pumpkin.

Use of the product of the invention requires stripping component 1 from the at least one adhesive bearing surface of Component 2, that adhesive bearing surface is contacted and adhered to the fruit or vegetable. The adherence of the sheet is best shown in FIGS. 4 and 5. In FIG. 4, it may be seen that the sheet is being pressed against the pumpkin which has a decorative image carved in it. As is shown in FIG. 5, the sheet may be lightly rubbed or smoothed to facilitate the adherence of the sheet onto the surface of the pumpkin.

Figure 8:
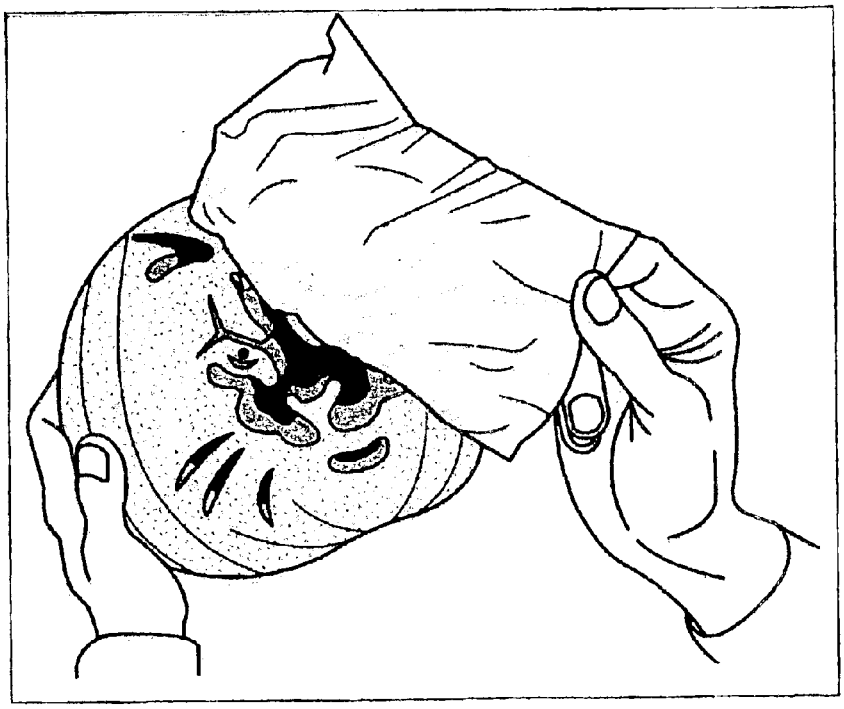
FIG. 8 shows the sheet being removed from the carved pumpkin.

Component 2, after the pumpkin has been manipulated so the nontoxic paint powder disperses and covers the interior of the pumpkin, is then removed from contact with the fruit or vegetable thereby revealing the decorative carving on the fruit or vegetable. In FIG. 8, it may be seen that, after the pumpkin has been manipulated so the nontoxic paint powder disperses and covers the interior of the pumpkin, the sheet is peeled off to reveal the carved pumpkin thereunder.

Figure 9:
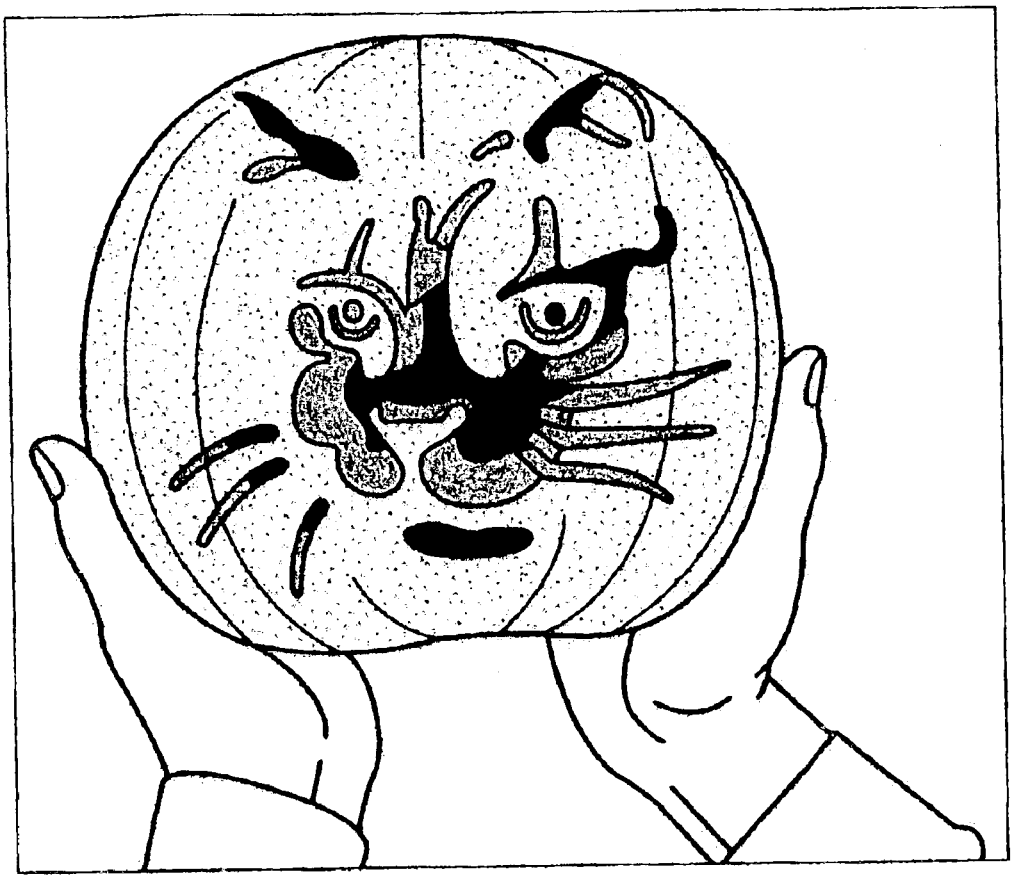
FIG. 9 shows the finished carved pumpkin with the decorative color from the nontoxic paint powder on the interior of the pumpkin and on the edges of the decorative carved image.

As may be seen in reference to FIG. 9, a decorated product in the form of a carved, colored pumpkin is shown in its completed form. Here, it may be seen that the decorated pumpkin has a design which includes a plurality of design elements, such as a pair of eyes (provided with pupils), nose, and mouth.

While the preferred embodiment of the present product, method and kit are described using a nontoxic paint power, it to be understood that a liquid nontoxic paint could be used in place of a nontoxic paint powder.

While the preferred embodiment of the present product, method and kit are described using a sheet of materials to cover decorative carvings in the fruit or vegetable and act as a barrier to keep the nontoxic paint powder inside the fruit or vegetable, it is to be understood that the sheet of materials is not needed if the interior of the fruit or vegetable is colored using the nontoxic paint powder before the decorative carving is done.

Accordingly, the present invention has been described with some degree of particularity directed to the exemplary embodiments of the present invention. It should be appreciated, though, that the present invention is defined by the following claims construed in light of the prior art so that modifications or changes may be made to the preferred exemplary embodiment of the present invention without departing from the inventive concepts Contained herein.

What is claimed is:

1. A method of decorating the interior surface of a fruit or vegetable having an area for displaying a design, comprising the steps of:

a) providing a sheet of materials of two components, component 1 and component 2, wherein component 1 is a sheet of material capable of acting as a release liner for component 2, and wherein component 2 is a sheet of material having a surface which will adhere to the surface of the fruit or vegetable;

b) removing component 1 from component 2;

c) contacting the fruit or vegetable so that component 2 is contacted and adhered to a surface of the fruit or vegetable over a decorative carved pattern;

d) placing a nontoxic paint inside the fruit or vegetable;

e) manipulating the fruit or vegetable so that the nontoxic paint disperses and covers the interior of the fruit or vegetable; and f) removing component 2 from contact with the fruit or vegetable thereby revealing the decorative carved pattern on the fruit or vegetable and the decorative color from the nontoxic paint.

2. The method of claim 1, wherein a general purpose permanent adhesive is used to adhere component 2 to the surface of the fruit or vegetable and said general purpose permanent adhesive is nontoxic to humans.

3. The method of claim 2, wherein the general purpose permanent adhesive used to adhere component 2 to the surface of the fruit or vegetable is a tackified self-adhesive.

4. The method of claim 2, wherein the general purpose permanent adhesive is a self-stick adhesive.

5. The method of claim 1, wherein said paint is a tempera paint.

6. The method of claim 1, wherein said paint is nontoxic to humans.

7. A method of decorating the surface of fruits or vegetables comprising:

a) providing a sheet of materials of two components, component 1 and component 2, wherein component 1 is a sheet of material capable of acting as a release liner for component 2, wherein component 2 is a sheet of material having a surface which will adhere to the surface of the fruit or vegetable, and wherein the surface of component 2 which adheres to the surface of the fruit or vegetable comprises a layer of moisture-sensitive adhesive;

b) wetting the moisture-sensitive adhesive and contacting it with a surface of the vegetable or fruit over a decorative carved pattern;

c) placing the nontoxic paint inside the carved fruit or vegetable;

d) manipulating the fruit or vegetable so that the nontoxic paint disperses and covers the interior of the fruit or vegetable; and e) removing the sheet from contact with the fruit or vegetable thereby revealing the decorative carved pattern on the fruit or vegetable and the decorative color from the nontoxic paint.

* * * * *